US008534723B2

(12) United States Patent
Berger

(10) Patent No.: US 8,534,723 B2
(45) Date of Patent: Sep. 17, 2013

(54) CONICAL SHANK ANTI-LIGATURE RELEASABLE DOOR LEVER

(75) Inventor: Mark J. Berger, New York, NY (US)

(73) Assignee: Securitech Group, Inc., Maspeth, NY (US)

( * ) Notice: Subject to any disclaimer, the term of this patent is extended or adjusted under 35 U.S.C. 154(b) by 455 days.

(21) Appl. No.: 12/590,135

(22) Filed: Nov. 2, 2009

(65) Prior Publication Data

US 2010/0126239 A1 May 27, 2010

Related U.S. Application Data

(60) Provisional application No. 61/197,887, filed on Oct. 31, 2008.

(51) Int. Cl.
*E05B 1/00* (2006.01)
*E05B 3/00* (2006.01)

(52) U.S. Cl.
USPC ..... 292/347; 292/336.3; 292/DIG. 65

(58) Field of Classification Search
USPC ..... 292/347–355, DIG. 65, 336.3; 49/460; 70/207, 209, 210
See application file for complete search history.

(56) References Cited

U.S. PATENT DOCUMENTS

| | | | | | |
|---|---|---|---|---|---|
| 4,646 | A | * | 7/1846 | Ires | 292/348 |
| 738,096 | A | * | 9/1903 | Caley | 292/356 |
| 1,164,849 | A | * | 12/1915 | Nilsen | 70/487 |
| 1,357,892 | A | * | 11/1920 | Nelson | 292/347 |
| 1,463,341 | A | * | 7/1923 | Somers | 292/348 |
| 1,568,567 | A | * | 1/1926 | Myers | 192/223.3 |
| 1,582,189 | A | * | 4/1926 | Nicholson | 292/356 |
| 1,764,945 | A | * | 6/1930 | Flynn | 292/348 |
| 1,876,654 | A | * | 9/1932 | Floraday | 192/215 |
| 2,163,101 | A | * | 6/1939 | Newton | 292/348 |
| 2,165,534 | A | * | 7/1939 | Brown | 292/348 |
| 2,459,920 | A | * | 1/1949 | Clark | 70/223 |
| 2,776,161 | A | * | 1/1957 | Gurski et al. | 292/353 |
| 3,345,103 | A | * | 10/1967 | Parkin et al. | 292/353 |
| 4,236,396 | A | * | 12/1980 | Surko et al. | 70/107 |
| 4,841,754 | A | * | 6/1989 | Jones | 70/207 |
| 6,062,616 | A | * | 5/2000 | Smolarski | 292/356 |
| 6,351,976 | B1 | * | 3/2002 | Chen | 70/224 |
| 6,463,630 | B1 | * | 10/2002 | Howie, Jr. | 16/441 |
| 6,691,538 | B1 | * | 2/2004 | Yang et al. | 70/370 |
| 7,219,519 | B1 | * | 5/2007 | Shen | 70/451 |
| 2010/0013248 | A1 | * | 1/2010 | Keller | 292/347 |
| 2010/0072762 | A1 | * | 3/2010 | Marks | 292/336.3 |
| 2011/0120024 | A1 | * | 5/2011 | Shilts | 49/506 |

* cited by examiner

*Primary Examiner* — Carlos Lugo
(74) *Attorney, Agent, or Firm* — Abelman, Frayne & Schwab

(57) ABSTRACT

A lever latch lock assembly including:

Figure 1A:
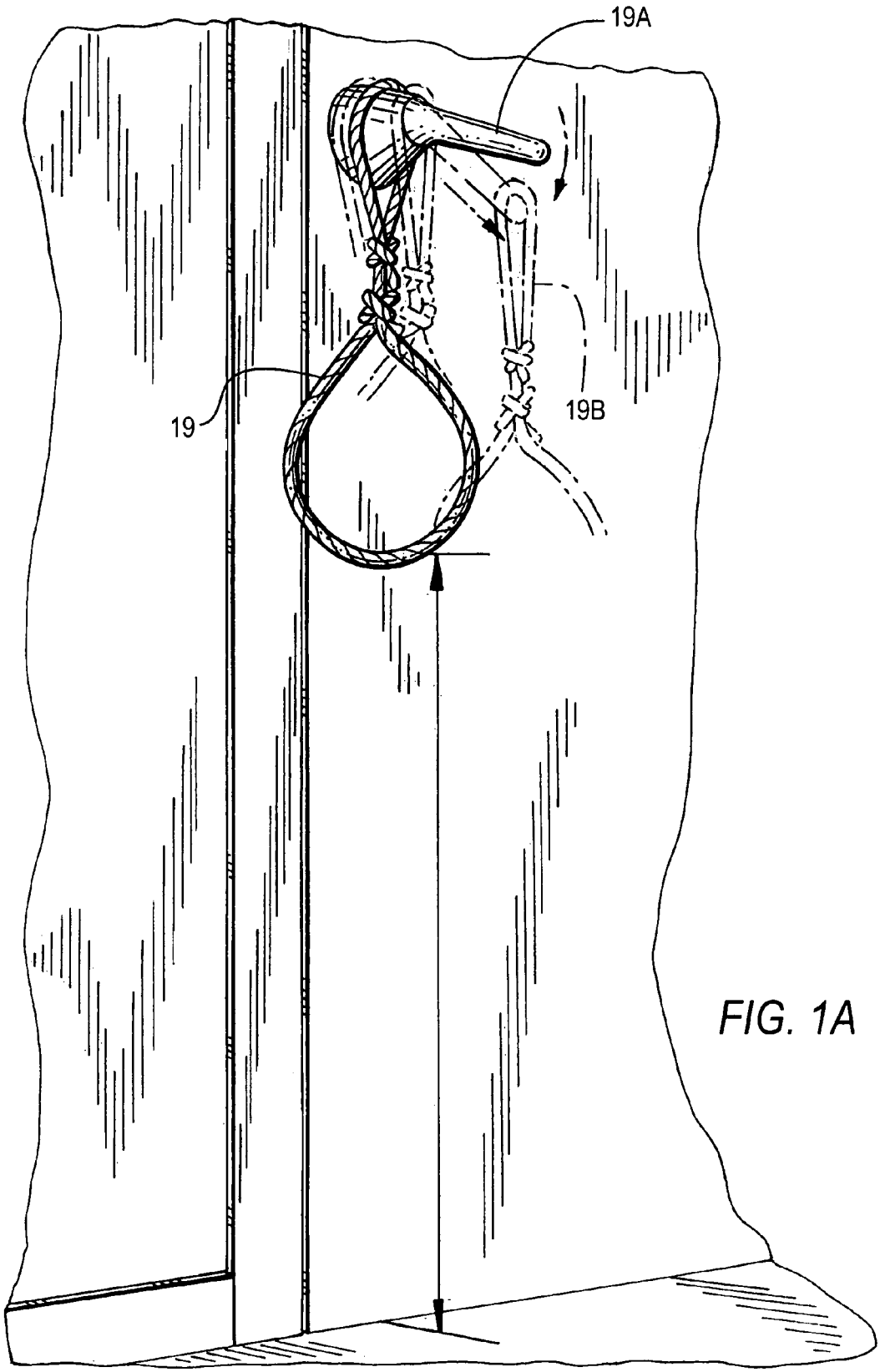

a. a lock housing mounted in the door including a lock bolt movable along a first axis, a spindle extending along a second axis generally perpendicular to the first axis, the spindle extending outward at each of the interior and exterior sides of the housing and terminating in opposite ends, and a transmission which converts rotation of the spindle to axial motion the lock bolt, b. a lever assembly attached to each of the spindle's ends and adapted to rotate the spindle, the lever assembly, including:

(1) an escutcheon formed as a truncated generally conical cylinder having (i) a base of first diameter adapted to be situated closely adjacent one of the interior and exterior sides of the door and coaxial with the second axis, (ii) a top end having a top edge opposite the base, the top end having a smaller diameter than the first diameter, and (iii) a bore through which extends the spindle, and (2) a lever including (i) a hub part and (ii) an elongated handle part extending from one side of the escutcheon in a direction transverse of the second axis, the handle having a top part that extends as a smooth contiguous uninterrupted surface from the top of the hub.

21 Claims, 10 Drawing Sheets

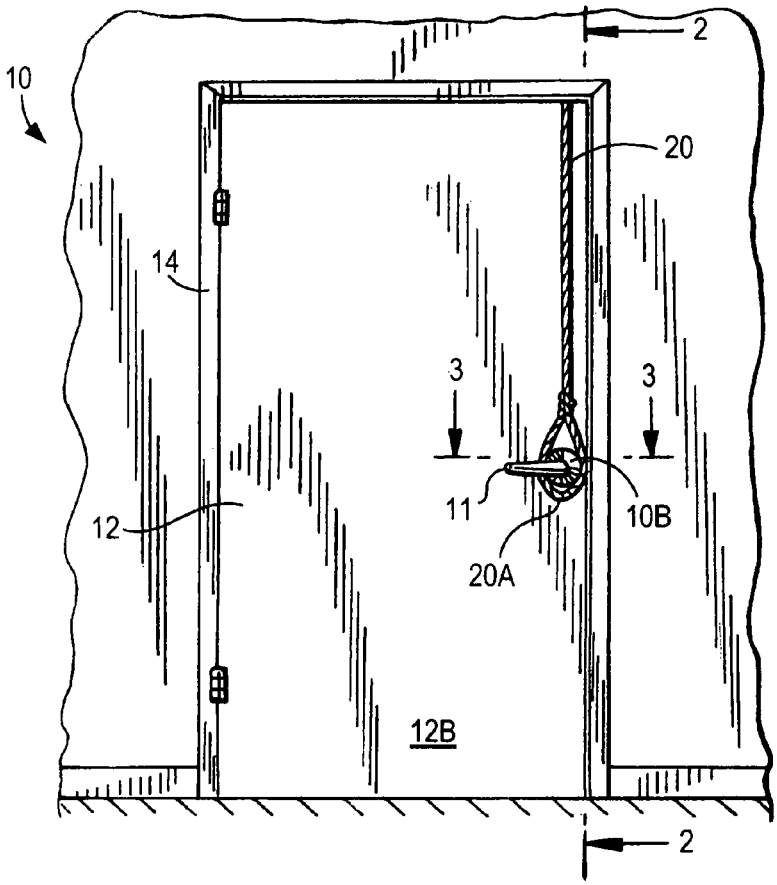
FIG. 1
FIG. 3
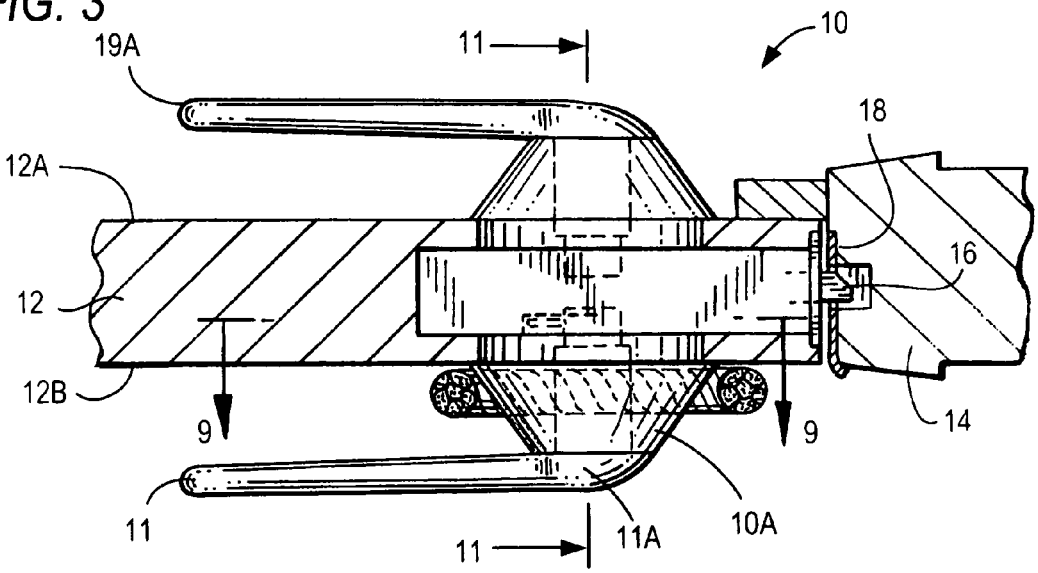

FIG.13
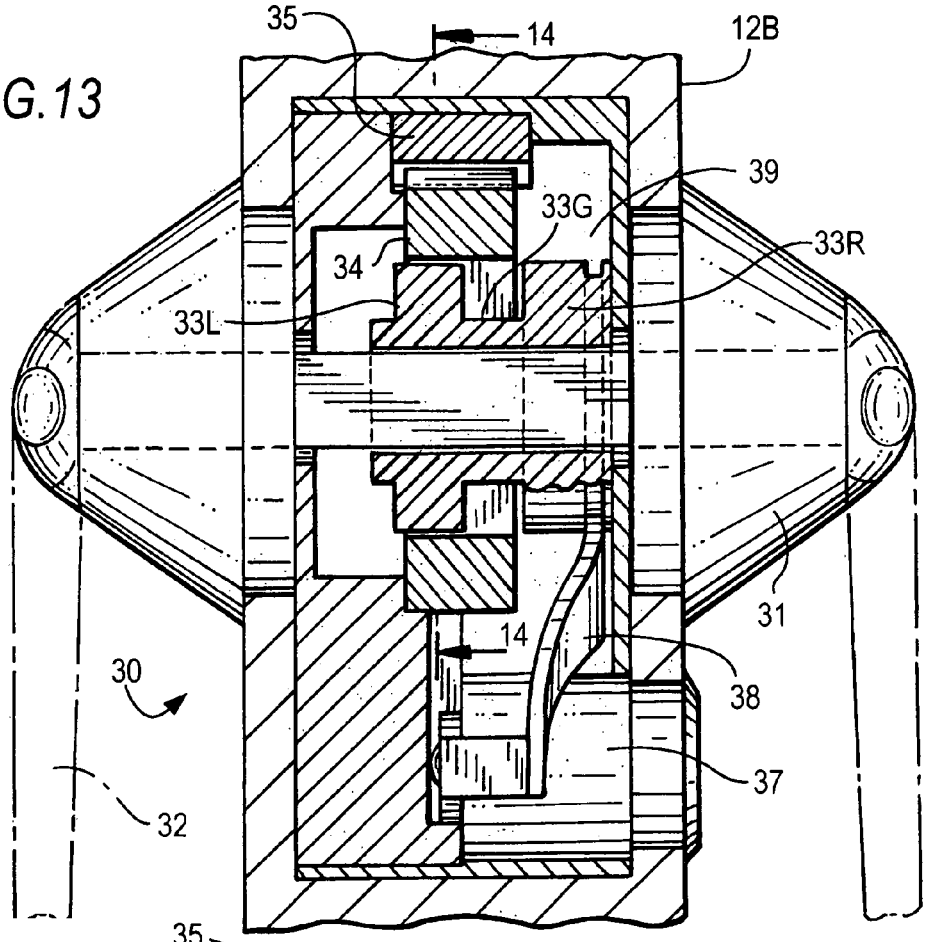
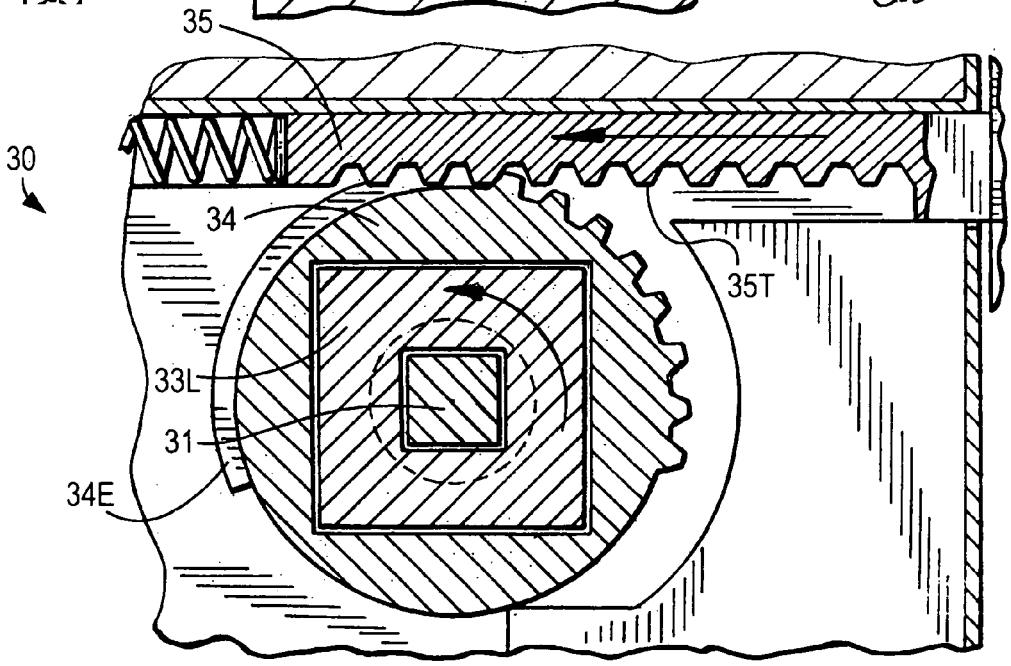
FIG.14

FIG.15
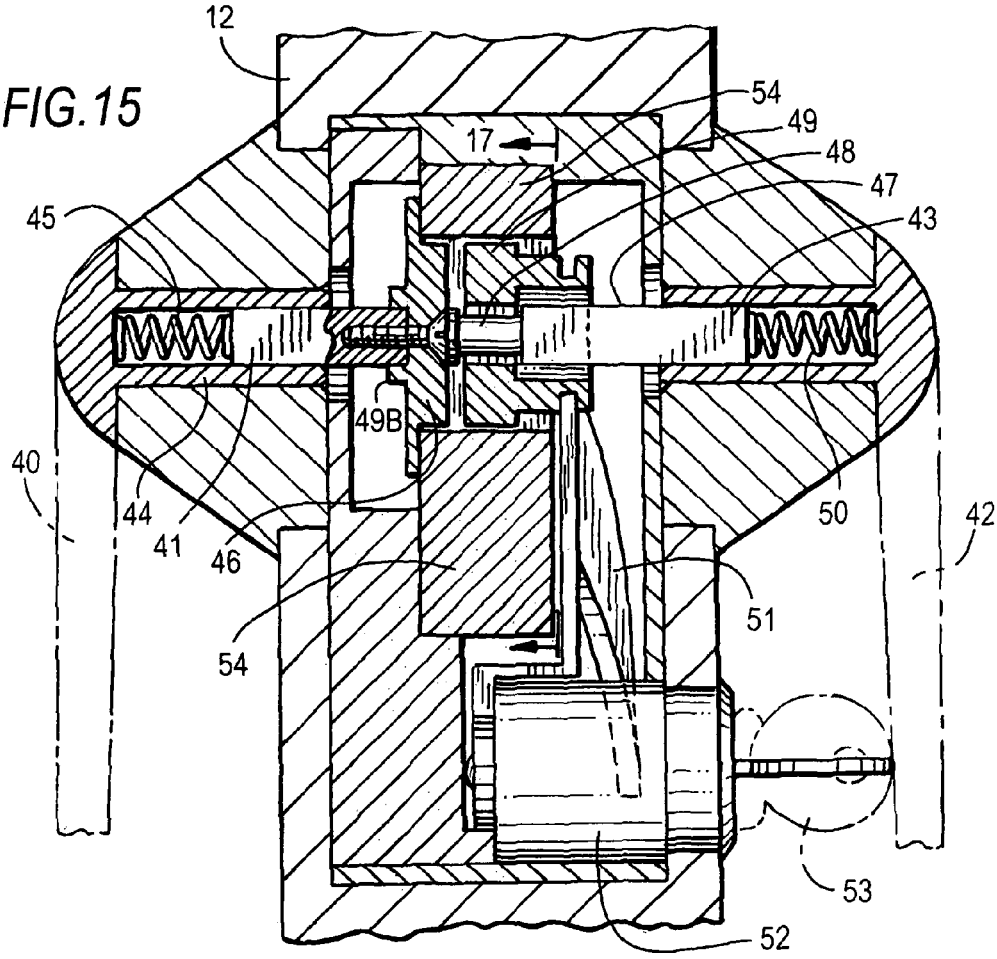
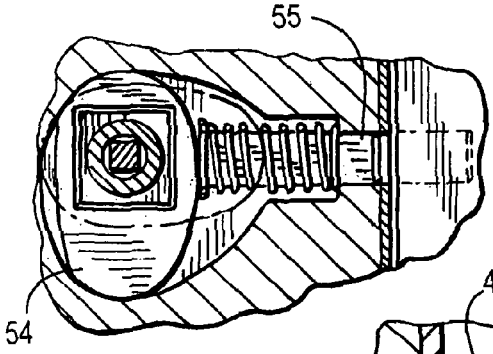
FIG.17
FIG.16
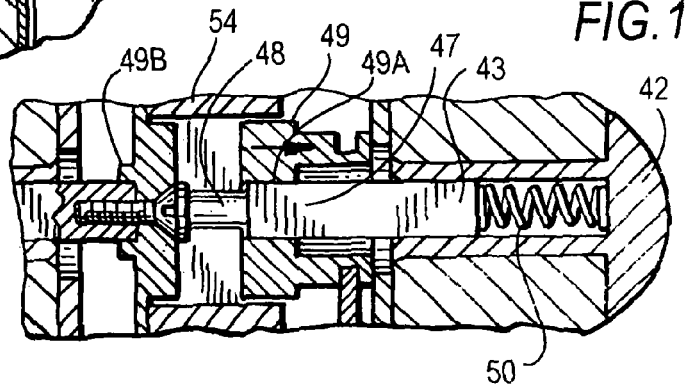

CONICAL SHANK ANTI-LIGATURE RELEASABLE DOOR LEVER

RELATED PATENT APPLICATION

This application claims priority under 35 U.S.C. §119, 120 based upon applicant's Provisional Patent Application Ser. No. 61/197,887, filing date of Oct. 31, 2008.

I. BACKGROUND OF THE INVENTION

1. Field of the Invention

This invention relates to a serious problem where certain patients in behavioral health care facilities or psychiatric institutions try to commit suicide by hanging themselves with cords or other items looped over the handles or knobs of doors to their rooms. This invention relates to methods and apparatus seeking to prevent such attempted suicides.

2. Background and Prior Art

It is known that certain patients in institutions try to commit suicide by various different means. Reasons for such behavior are complex and not the subject of the present invention; however, significant numbers of attempts do occur, and significant numbers of patients are committed into these institutions for the very reason that they are known to be candidates for suicide attempts and these institutions are supposed to be environments for treatment of these and other problems and for prevention of patients from achieving suicide.

While the methods employed for the attempted suicides vary with the available environment and creativity of the patients, the present invention is concerned with attempts by hanging with a cord, belt or other item with the near or proximal portion of the cord wrapped around the door knob, lever or other handle of a door. The distal or remote end of the cord, belt or other item on the interior side of the door is formed into the suicidal noose and then either draped over the door to the far side door knob or handle, or, if short, the patient attempts suicide by dropping down to the floor from the doorknob, lever or other handle on either side of the door.

In typical psychiatric institutions the patients' activities, as regards personal safety and behavior in general, are monitored carefully by staff; however, it is also common for patients to have private rooms with unlocked doors for them to come and go generally as they please. It is in these kinds of situations where a patient has periods of relative privacy and domain over his or her door, when a suicide attempt can be made without immediate awareness of institution staff and with enough time for the suicide to be successful before staff action can be taken. For various reasons there are surprisingly high numbers of attempted and successful suicides in psychiatric institutions that are not generally publicized or known, but administrators of these institutions are quite aware and concerned. The present invention addresses these tragedies and presents a practical apparatus believed to be able to significantly reduce the problem on a nationwide basis.

The present invention will be described herein as it functions within the known protocols of "Passage Mode" and "Classroom Mode" door lock systems. In Passage Mode the door lock is set so that a person can exit a room by pushing down on the interior side lever, and a person can enter the room by pushing down on the exterior side lever. In Classroom Mode the door lock is set differently so that a person inside the room can exit by pushing down on the lever; however, the lockset can be set to function by use of a lever, button, turn piece or key lock feature, in either (a) "Classroom (Locked) Mode" where pushing down on the exterior side lever will not open the door, to prevent patients from entering rooms without supervision, or (b) Classroom (Unlocked) mode which is like the above mentioned Passage Mode. These Passage and Classroom Mode protocols are continued in the present invention, as will be apparent herein and as are further illustrated in the attached Appendix A.

II. OBJECTS AND SUMMARY OF THE NEW INVENTION

A first object of the present invention is to provide a method and apparatus to counter-act suicide attempts and thus to reduce the incidence of successful suicides in psychiatric hospitals and mental health wards, particularly regarding suicide attempts by hanging with a cord draped by a patient over the door in his or her room, with the distal or remote end of the cord tied or otherwise secured to the door lever or door knob on the exterior side of the door. Classroom Mode (Locked) is used to prevent patients from entering rooms without supervision. This object similarly concerns counter-acting suicide attempts by a patient who attaches a cord to the lever on either side of the door and attempts suicide by applying the noose and dropping down to the floor.

A further object of this invention is to install on a patient's door a new "Anti-Ligature Lever Latch Lock" or "A4L", which will be resistant to a patient's suicide attempts to use a cord or ligature draped over the door and tied to a door lever or turn piece on the exterior or interior side of the door.

An additional object is to provide a new A4L system that is ADA-compliant, namely compliant with the Americans With Disability Accessibility Guidelines ("ADAG").

Another object is to provide an ADA-compliant A4L lock system designed to function with conventional mortise latch lock or cylindrical latch lock openings in widely used conventional doors, as applied to both newly constructed doors and as a retrofit applied to doors already installed and in use.

A still further object is to provide a lock set which functions optionally in Passage Mode, Classroom Mode (Locked), and Classroom Mode (Unlocked). One preferred mechanism for Classroom Mode (Locked) is a keyed mechanism to decouple the lever from the latch engagement mechanism so that pivoting the external side lever will not open the door.

A still further object, in regard to any suicide attempt where the ligature is tied to said handle, is to provide an ADA-compliant A4L lock system where the escutcheon is conical and the proximal or shank portion of the lever/handle is coupled to the escutcheon and continues the conical shape in a smooth junction that will enhance the tendency of a ligature to slide down the conical escutcheon and off the conical shank of the handle/lever.

An additional object herein is to provide an A4L lock body which is operable in both of the earlier described Passage and Classroom Modes, as explained herein.

(A) In Passage Mode the lever can be pushed downward against normal spring and friction resistance from both interior and exterior sides of the door to open said door, and the lever can be pivoted upward freely on both interior and exterior sides with no or only minimal resistance. A ligature tied to the exterior or interior side lever and pulled upward in a suicide attempt, will slide off the lever, since this lever pivots freely upward and downward and will offer no resistance to the ligature.

(B) In Classroom Mode (Locked) a person can push the interior side handle downward to leave the room; however, on the exterior side the lever will not retract the latch, so that a person cannot enter without release of the lock by someone inside or by a person outside with a release key. In this Classroom Mode an unauthorized person cannot enter the room, and that includes the patient when such patient is expected to be out the room and in a different specified location; however, in Classroom Mode (Locked) and (Unlocked) the interior and exterior levers are freely pivotable upward and downward, so that the anti-ligature protocol remains in force and protection against suicide by a cord tied to either lever is prevented, even though the door is in "Locked" Mode.

In one preferred embodiment the door's mortise lock body has special properties and/or the spindle has special properties to allow the lever to move freely at all times in Classroom Mode (Locked), where the spindle will not engage the latch in this mode.

A further object of the present invention is to provide for the door latch lock mechanism a lever having shape and contours to induce any ligature looped by a patient over or onto the lever to readily slide off and thus defeat the suicide by hanging attempt. To that end, the new lever comprises a truncated conical escutcheon part and a lever having a rounded or cap-like hub part and a transversely extending handle where a smooth uninterrupted surface is established along the side of the escutcheon and its function with the hub of the handle.

In a preferred embodiment, the base of the hub part has a circumferential edge essentially the same as the top edge of the escutcheon so that the function is smooth and uninterrupted on the outwardly exposed surfaces as illustrated in the appended drawings. A further feature in this preferred embodiment is the transverse extension of the handle of the top portion of the curved hub part to further establish the continuous exposed surface and junction of the hub and handle with absence of any projections or edges on which the ligature could catch. In the preferred embodiment shows the escutcheon having conical walls extending at an angle of about 55° from the plane of the base of the escutcheon and the hub curvature is generally hemispherical; however, variations of the incline of the escutcheon walls and if the hub curvature are possible, so long as the ligature will readily slide off the lever.

The present invention relates particularly to apparatus to automatically respond to attempted suicide and efforts to prevent it from succeeding. The apparatus described herein would immediately release the distal end of the cord and defeat the suicide attempt.

An additional object of the present invention is to provide the above described apparatus in a form that can be installed in standard doors used in a great many buildings and commonly used in psychiatric institutions, where installation can be easily done doors where standard preparations have been made in factories at time of initial manufacture and also as a retrofit onto existing doors wherever they may be.

It is a further object that such installation be simple and reasonable in cost and reliable in use. It is expected that the retrofit procedure will be quite easy, since common commercial and institution building doors have relatively standard size door preparation for the components of door levers, shanks and related mechanisms, which components can be readily removed and replaced with a substitute A4L subassembly.

An additional object is to provide apparatus that is nonobtrusive so that it will not attract the patient's attention, while still being esthetically attractive.

These and other advantages of the invention will be further understood and appreciated by those skilled in the art by reference to the following written specification, claims and appended drawings.

The present invention is further defined by the following structures:

1. A lever latch lock assembly installable in a door having interior and exterior sides, said assembly when installed in a door, comprising:
   a. a lock housing mounted in said door and having interior and exterior sides, said housing including a lock bolt movable along a first axis, a spindle extending along a second axis generally perpendicular to said first axis, said spindle extending outward at each of said interior and exterior sides of said housing and terminating in opposite ends, and a transmission which converts rotation of said spindle to axial motion said lock bolt,
   b. a lever assembly attached to each of said spindle's ends and adapted to rotate said spindle, said lever assembly, including:
      (1) an escutcheon formed as a truncated generally conical cylinder having
         (i) a base of first diameter adapted to be situated closely adjacent one of said interior and exterior sides of said door and coaxial with said second axis,
         (ii) a top end having a top edge opposite said base, said top end having a smaller diameter than said first diameter, and
         (iii) a bore through which extends said spindle, and
      (2) a lever including
         (i) a hub part having a generally hemispherical body with a generally round circumferential bottom edge substantially the same and adjacent said top end edge of said escutcheon and forming a smooth continuous junction therewith, and having a smooth convex top, and
         (ii) an elongated handle part extending from one side of said escutcheon in a direction transverse of said second axis, said handle having a top part that extends as a smooth contiguous uninterrupted surface from said top of said hub.

2. A lever latch lock according to the structure "1" referred to above in Par. No. 0023 wherein said hub includes an axial recess extending in the direction of said bottom to said top thereof, and said spindle end is extended into said recess and keyed to rotate therewith.

3. A lever latch lock assembly according to the structure "1" referred to above in Par. No. 0023 wherein said hub part of said lever and said escutcheon have a common central axis.

4. A lever latch lock assembly according to the structure "1" referred to above in Par. No. 0023 wherein said escutcheon walls are inclined at about 55 degrees from the plane of the base of the escutcheon.

5. A lever latch lock assembly according to the structure "1" referred to above in Par. No. 0023 wherein said elongated handle part extends along a plane that defines an angle of about 91 degrees with said spindle axis and is inclined away from said door surface.

6. A lever latch lock assembly according to the structure "1" referred to above in Par. No. 0023 wherein said levers on said interior and exterior sides of said door can pivot from a generally horizontal rest position downward or upward, and said transmission is adapted so that either of said interior and exterior side levers can always freely pivot upwardly when pulled upward, and said transmission will engage said lock bolt to allow said door to open when said transmission is selectively directed to do so.

7. A lever latch lock assembly according to the structure "1" referred to above in Par. No. 0023 wherein said transmission means has:

(a) a Classroom Unlocked Mode where said exterior side lever is pivotable from said rest position downward which will move said lock bolt and open said door, and said lever is freely movable upward to an "anti ligature latch lock" release position, and (b) a Classroom Locked Mode where said lever is pivotable from its rest position downward which will not open said door and is freely movable upward to said "anti ligature latch lock" release position.

8. A lock assembly according to the structure "7" immediately above wherein said transmission has a Passage Mode where movement of said lever downward in said Passage Mode lever on either interior or exterior side of said door will engage said transmission and move said bolt to open said door.

9. A lock assembly according to the structure "7" immediately above wherein movement of said lever upward in said Passage Mode will not move said bolt.

10. A lock assembly according to the structure "1" referred to above in Par. No. 0023 [see claim 2] wherein said transmission further comprises a switch movable between a first position Passage Mode which allows said lever to move downward without moving said bolt to its open state, and a second position for said Classroom Locked Mode which allows said lever to move downward to move said bolt to its open state.

11. A combination door and lever latch lock assembly installed therein, said door having interior and exterior sides, comprising:

a. a lock housing mounted in said door and having interior and exterior sides adjacent and corresponding to said interior and exterior sides of said door, said housing including a lock bolt movable along a first axis, a spindle extending along a second axis generally perpendicular to said first axis, said spindle extending outward at each of said interior and exterior sides of said housing and terminating in opposite ends, and a transmission which converts rotation of said spindle to axial motion said lock bolt, b. a lever assembly attached to each of said spindle's ends and adapted to rotate said spindle, said lever assembly, including:

(1) an escutcheon formed as a truncated generally conical cylinder having (i) a base of first diameter adapted to be situated closely adjacent one of said interior and exterior sides of said door and coaxial with said second axis, (ii) a top end having a top edge opposite said base, said top end having a smaller diameter than said first diameter, and (iii) a bore through which extends said spindle, and (2) a lever including (i) a hub part having a generally hemispherical body with a generally round circumferential bottom edge substantially the same and adjacent said top end edge of said escutcheon and forming a smooth continuous junction therewith, and having a smooth convex top, and (ii) an elongated handle part extending from one side of said escutcheon in a direction transverse of said second axis, said handle having a top part that extends as a smooth contiguous uninterrupted surface from said top of said hub.

12. A lever latch lock assembly installable in a door having interior and exterior sides, said assembly when installed in a door, comprising:

a. a lock housing mounted in said door and having interior and exterior sides, said housing including a lock bolt movable along a first axis, a spindle extending from each side of said housing along a second axis generally perpendicular to said first axis, each of said spindles extending outward at each of said interior and exterior sides of said housing and terminating in opposite ends, and a transmission which selectively converts rotation of said spindles to axial motion said lock bolt, b. a lever assembly attached to said end of each of said spindles and adapted to rotate said spindle, said lever assembly, including:

(1) an escutcheon formed as a truncated generally conical cylinder having (i) a base of first diameter adapted to be situated closely adjacent one of said interior and exterior sides of said door and coaxial with said second axis, (ii) a top end having a top edge opposite said base, said top end having a smaller diameter than said first diameter, and (iii) a bore through which extends said spindle, and (2) a lever including (i) a hub part having a generally hemispherical body with a generally round circumferential bottom edge substantially the same and adjacent said top end edge of said escutcheon and forming a smooth continuous junction therewith, and having a smooth convex top, and (ii) an elongated handle part extending from one side of said escutcheon in a direction transverse of said second axis, said handle having a top part that extends as a smooth contiguous uninterrupted surface from said top of said hub.

III. BRIEF DESCRIPTION OF THE DRAWINGS

Figure 2:
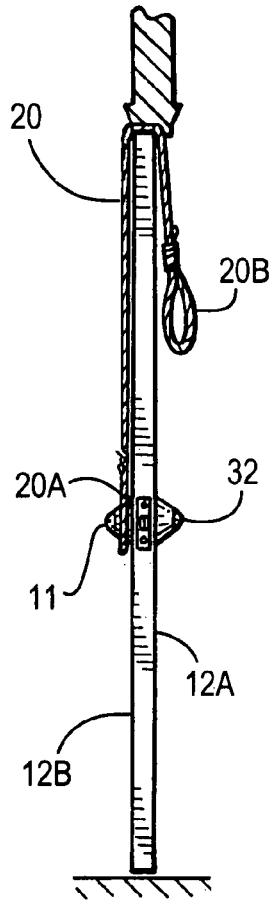
Figure 4:
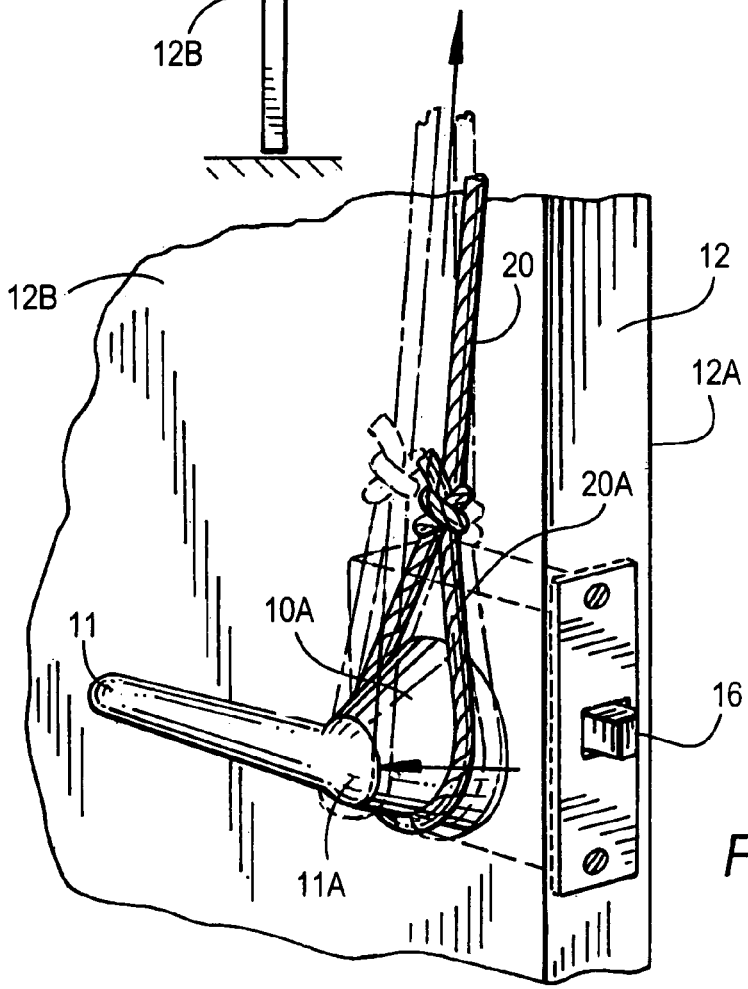
Figure 8:
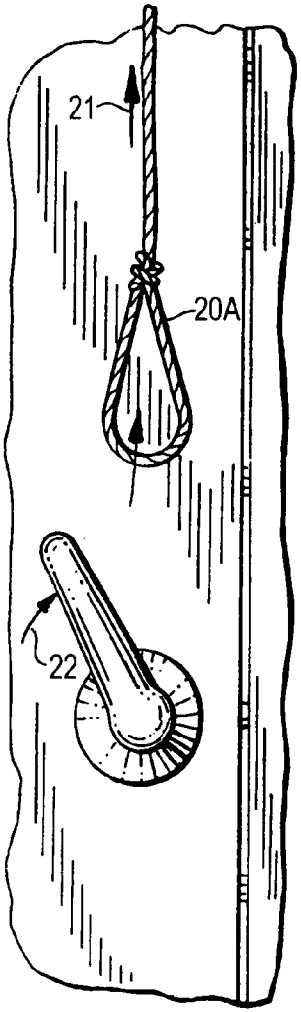
Figure 9:
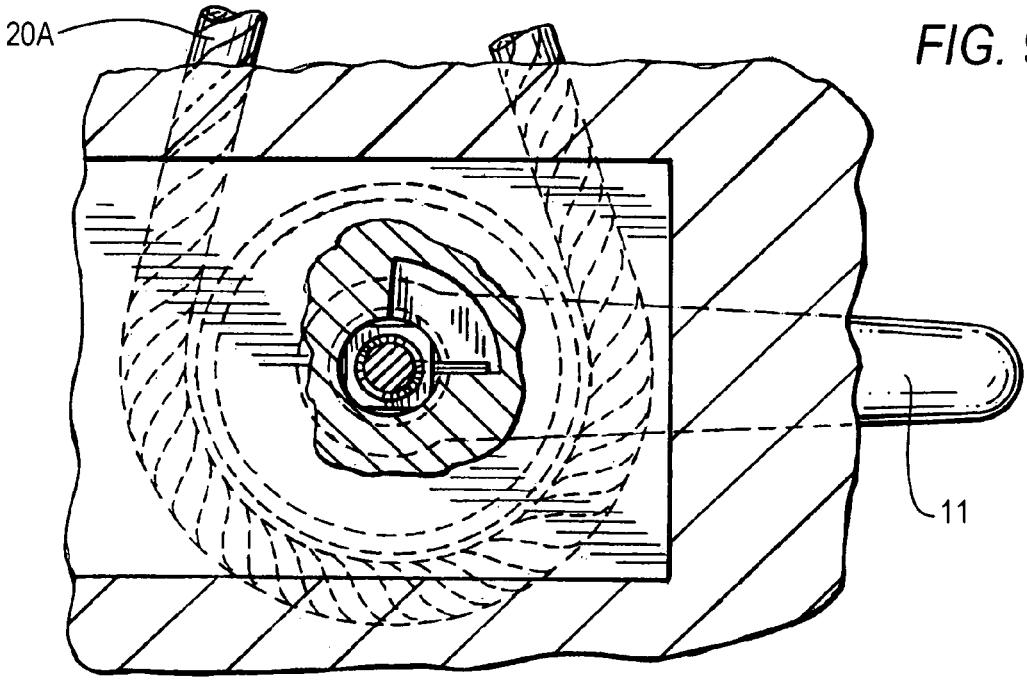
Figure 10:
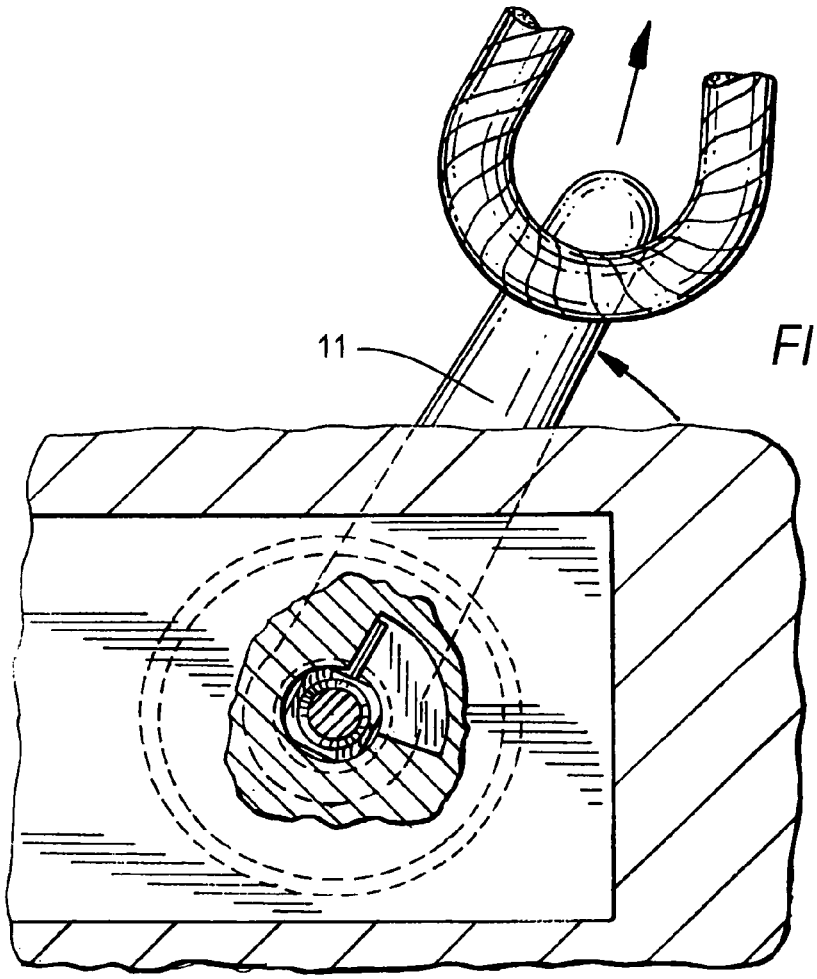
Figure 11:
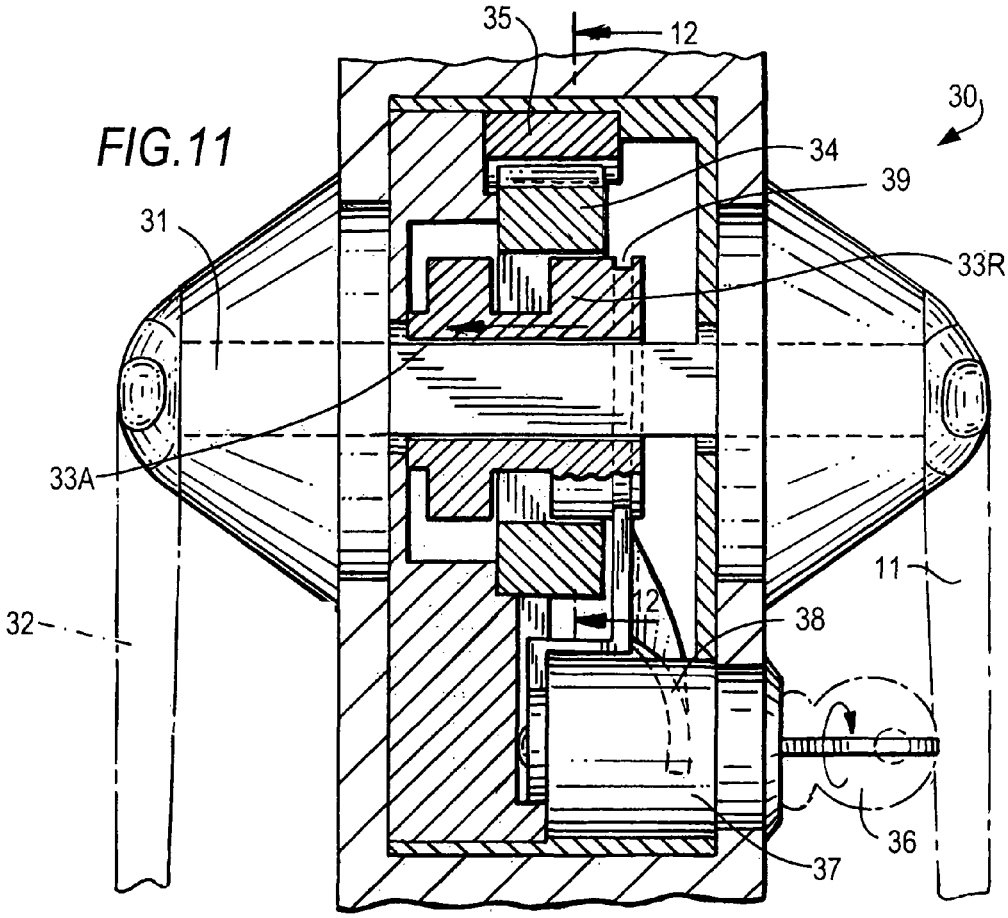
Figure 12:
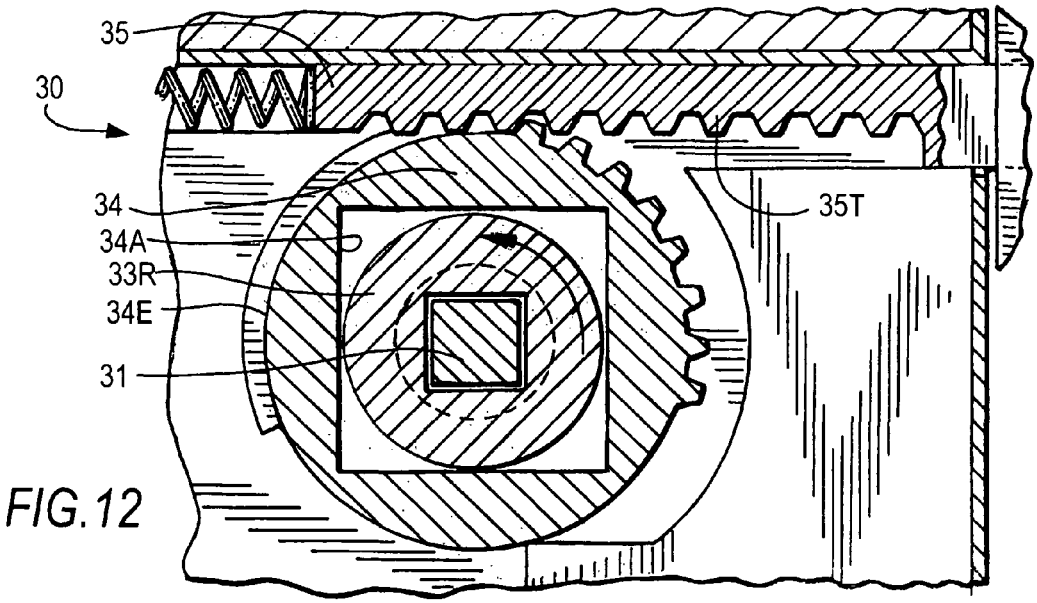
Figure 18:
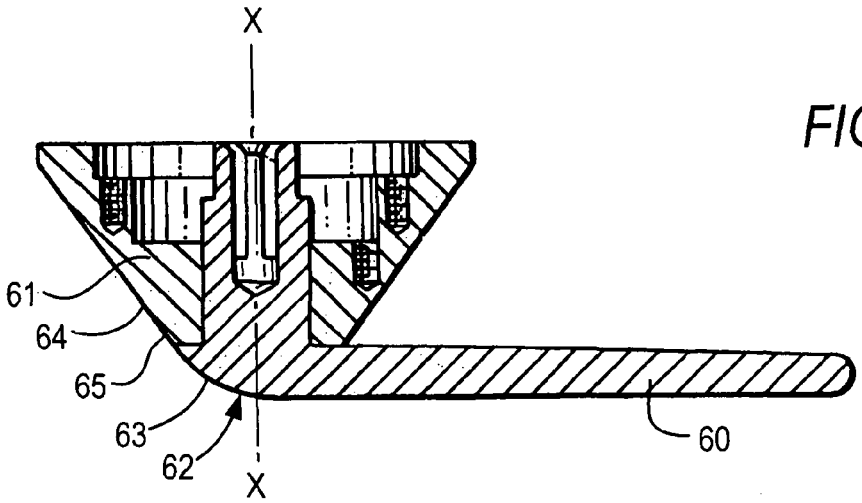
Figure 19:
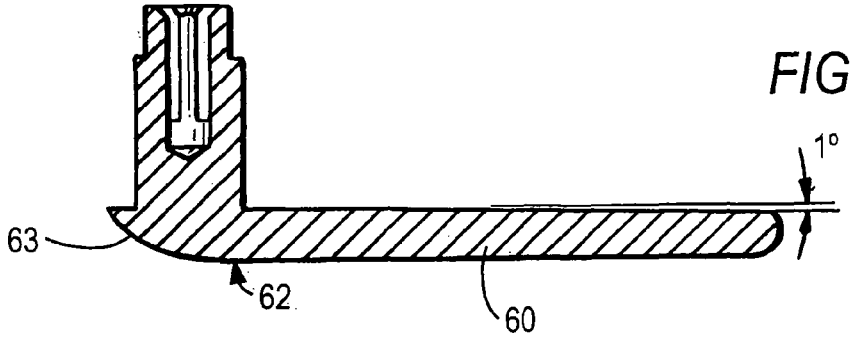
Figure 20:
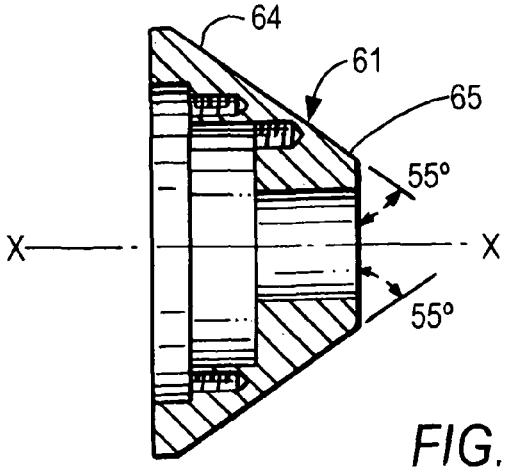
Figure 21:
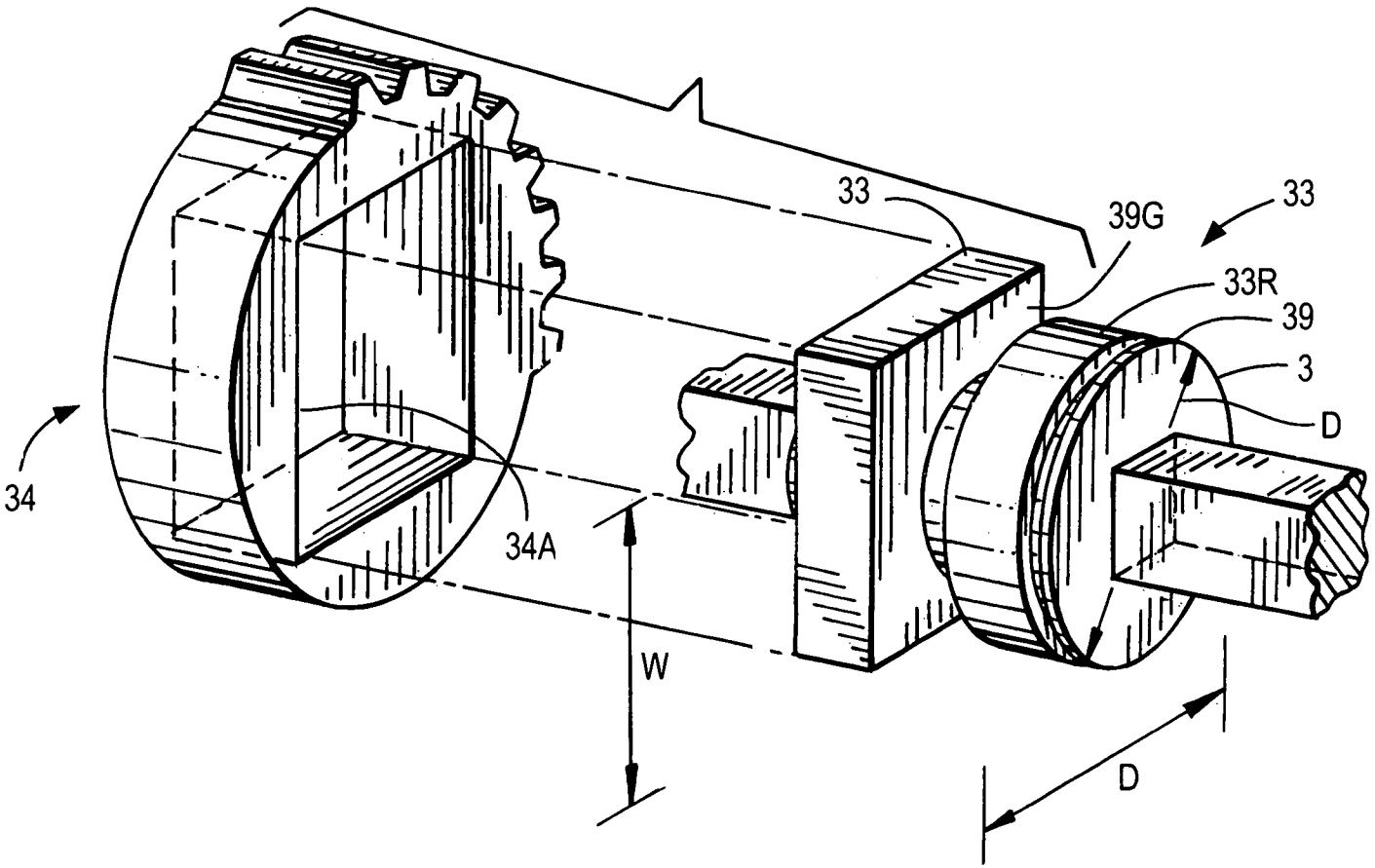

FIG. 1 is a fragmentary front elevation view of a door mounted in a door frame with the new conical shank anti-ligature door lever lock, FIG. 1A is a fragmentary front perspective view of a ligature looped about the lever on a patient's door and then slipping off when suicide is attempted, FIG. 2 is a fragmentary end elevation view in section taken along line 2-2 in FIG. 1, showing the ligature for use in an attempted suicide, FIG. 3 is a top plan view in section taken along line 3-3 in FIG. 1, FIG. 4 is a fragmentary front perspective view of the door and conical shank anti-ligature door lever, FIGS. 5-8 are fragmentary front elevation views of the door and lock of FIG. 1, showing how the distal end of a ligature will slide off the exterior side lever of the new A4L as the distal end of the ligature is pulled upward, FIG. 9 is a fragmentary enlarged elevation view in section taken along line 9-9 in FIG. 3 showing the distal end of the ligature looped over or tied about the lever in its horizontal position, FIG. 10 is a view similar to FIG. 9 showing the lever in its upward position with the distal end of the ligature slipping off of the lever, FIG. 11 is a fragmentary elevation view partially in section taken along line 11-11 in FIG. 3, showing the mechanism for switching the spindle collar to left-side Position A, FIG. 12 is a fragmentary sectional view taken along line 12-12, FIG. 13 is a fragmentary elevation view partially in section taken along line 11-11 in FIG. 3, showing the mechanism for switching the spindle collar to right-side Position B, FIG. 14 is a fragmentary sectional view taken along line 14-14 in FIG. 13, FIG. 15 is a fragmentary end elevation view in section of another preferred embodiment of the present invention showing two separate coaxial spindle segments for the inside and outside levers respectively, FIG. 16 is a fragmentary view of the central portion of FIG. 15 with the collar shown shifted to the right, FIG. 17 is a fragmentary side elevation view in section taken along line 17-17 in FIG. 15 showing a cam driven by the spindle for actuating the locking bolt, FIG. 18 is a top plan view in section of a preferred lever and truncated conical escutcheon, FIG. 19 is a top plan view in section of the lever alone seen in FIG. 18, FIG. 20 is a top plan view in section of the escutcheon alone seen in FIG. 18, and FIG. 21 is a perspective view of the door lock coupling or transmission mechanism of FIGS. 11-17.

While the invention has been described in conjunction with several embodiments, it is to be understood that many alternatives, modifications, and variations will be apparent to those skilled in the art in light of the foregoing description. Accordingly, this invention is intended to embrace all such alternatives, modifications, and variations which fall within the spirit and scope of the appended claims.

IV. DETAILED DESCRIPTION OF THE PREFERRED EMBODIMENTS

FIGS. 1-10 illustrate the new A4L System 10 in operation on a conventional door 12 that is pivotally mounted in door frame 14, with bolt 16 engagable in strike 18 in said door frame. One principal component of this A4L System is the conical escutcheon 10A and lever 11 combination. In an attempted suicide a patient would extend a ligature 20 over the top of the door 12, couple the ligature's distal end 20A to lever 11 on the exterior side 12B of door 12, and form the ligature's proximal end 20B into a noose that hangs down the interior side 12A of door 12.

The present invention is designed to defeat such an attempted suicide with an automatic decoupling and release of the distal end 20A of the ligature 20 from the exterior side door lever 10A, 11, 11A when suicide is attempted on the interior side. The invention further includes an optional keyed operation to alter the door latch mechanism from Classroom (Locked) to Classroom (Unlocked) Mode, although the Lever in both modes the Anti-Ligature Release arrangement is maintained.

The Anti-Ligature Release System

FIGS. 1-4 show the first stage of a ligature suicide attempt where the distal end 20A of ligature 20 has been tied or looped about the new lever construction formed of a rounded lever hub 11A, a conical escutcheon 10A and lever 11 on the exterior side 12B of door 12. FIG. 2 shows proximal end 20B of the ligature poised by a patient for the suicide attempt.

Figure 6:
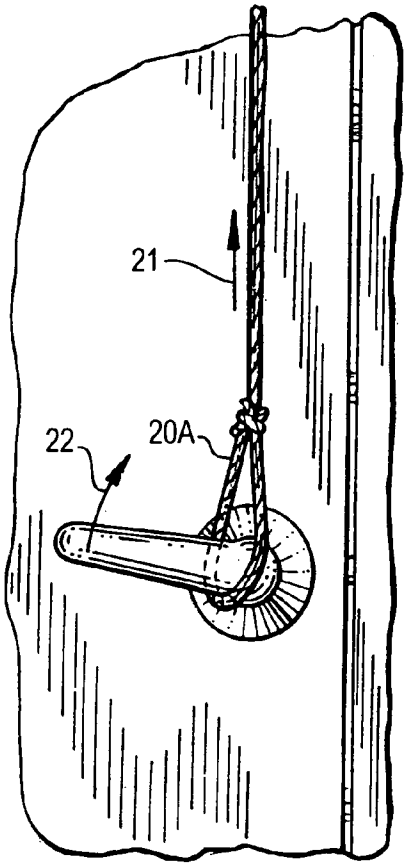
Figure 5:
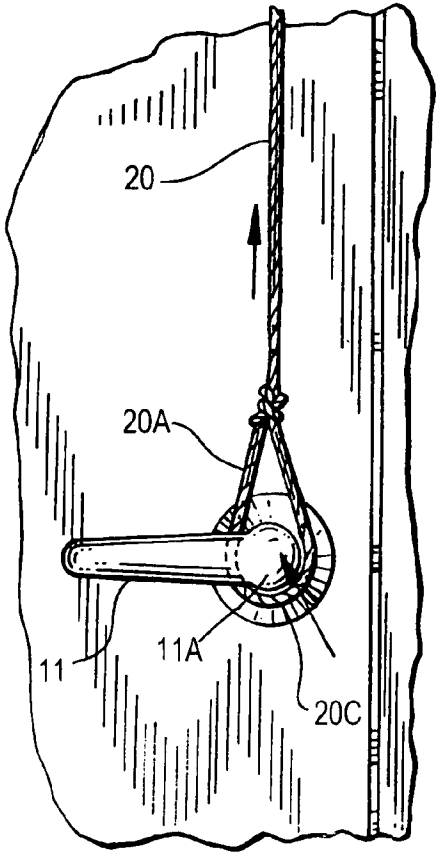

FIG. 5 shows the ligature's distal end 20A looped over lever and hub 11, 11A with ligature 20 beginning to be pulled upward by the force of the patient's body weight on the interior side, the force indicated by arrow 21. FIG. 6 shows, with arrow 22, lever 11 beginning to pivot upward as force 21 continues to pull upward which drags the lower loop part 20A of ligature 20 against the curved or conical surface of hub 11A, such that the loop 20A starts to slip off hub 11A and onto lever 11.

Figure 7:
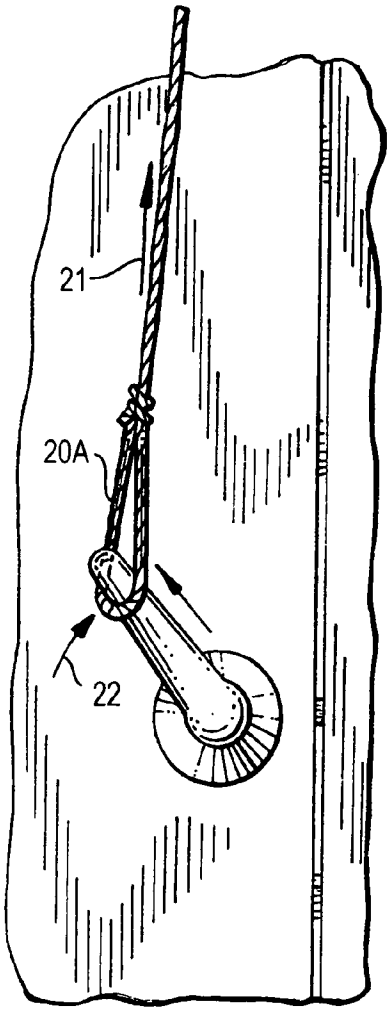

FIG. 7 shows lever 11 pivoted still further in the upward and clockwise direction of arrow 22 as force indicated by arrow 21 continues, and loop 20A has slid toward the end of lever 11. FIG. 8 shows that loop 20A has slid completely off lever 11, and obviously at this point with the proximal end 20B still about the patient's neck; the patient's body will have fallen to the floor, and the hanging has been stopped. FIGS. 9 and 10 further illustrate lever 11 and its internal coupling, corresponding to lever positions in FIGS. 5 and 8 respectively.

FIG. 1A illustrates a variation of a suicide attempt where the ligature is coupled to the lever on the interior side of the door of the patient's room, with ligature 19 looped over the lever 19A; the dashed line 19B illustrates how the ligature 19 slips off the lever when suicide is attempted.

FIGS. 3, 4 and 6 show clearly how the outer tapered surface of hub 11A meets seamlessly with the adjacent conical escutcheon 10A. Due to the continuous curve of escutcheon 10A and hub 11, the looped distal end 20A of ligature 20 will initially slide from the escutcheon 10A or hub portion 11A onto lever 11. With further pulling of ligature 20, distal end loop 20A will have no choice but to slide off lever 11. Upward rotation of lever 11 during a suicide attempt may be coupled with circuitry not shown, to trigger an alarm indicating the upward pivoting of lever 11 and/or possible suicide attempt.

Switching The Door Latch Mechanism from Classroom (Locked) to Classroom (Unlocked) Modes.

Numerous mechanisms are known for allowing levers on interior and exterior sides of a door to selectively engage the latch bolt to open the door or to pivot without engaging the latch bolt, or to be barred from turning. The mechanism illustrated in FIGS. 11-17 are presented as exemplary of the functions discussed herein of the lever latch lock assembly in combination with the new conical escutcheon lever sub-assembly designed as an improved anti-ligature releasable door lever to defeat ligature type suicide attempts. FIGS. 11-17 illustrate the above-mentioned keyed switch feature within the A4L latch lock mechanism housing 30 in door 12 applicable in Classroom Mode (Locked). In FIG. 11 spindle or main door lever shaft 31 is fixedly coupled to exterior side lever 11. Collar 33 is axially movable on spindle 31 from Position A seen in FIGS. 11 and 12 corresponding generally to Lever-Dis-engaged Mode where entry from the exterior side is barred, to Position B seen in FIGS. 13 and 14 representing Lever-Engaged Mode where entry from the exterior side is allowed by pushing down on lever 11.

The switch mechanism is adapted to drive collar 33 between Position A (See FIG. 12) and B (See. FIG. 14) to cause release or driving engagement respectively of latch bolt 35. As discussed above, in drive engagement of Position B, (to the right as seen in FIG. 14) upward pivot of the lever will drive bolt 35 out of the strike, allowing the door to open. This mechanism may take a variety of cam, gear or other structural forms, with the structure shown in FIGS. 11-14 being merely one that illustrates simply the principle of operation, as further described below. In these figures door 12 has a conventional mortise latch lock housing and assembly 30 with main spindle or shaft 31. As seen in FIGS. 11, 12 and 21 spindle 31 has a square cross-section along its length with its ends coupled to exterior side lever 11 and interior side lever 32 respectively. Pivoting of either lever rotates spindle 31. Slidable on spindle 31 is collar or hub 33 that has right portion 33R which is round, left portion 33L which is square, center recess 33G, and groove 39 to be discussed later. Collar 33 has a square bore 34A dimensioned to allow collar 33 to slide easily on the square exterior surface of spindle 31 and is keyed to be rotated by any rotation of spindle 31. Thus, collar 33 can be displaced axially on spindle 31 between (a) a right side Position B toward the exterior side of door 11 seen in FIGS. 13, 14, and (b) a left side Position A toward the interior side of door 11 seen in FIGS. 11, 12.

Between the left and right side portions of collar 33 is recess 33G to serve as clearance to separate right and left side portions 33L and 33R when switching between positions A and B. In the surface of the right side portion is a shallow groove 39 to be described later.

When collar 33 is shifted to the left as seen in FIGS. 11 and 12, its right end portion 33R of round circumference D becomes situated in the square bore 34N of slightly greater diameter of gear 34 and turns freely therein. Consequently, pivoting of levers 32 or 11 on opposite sides of the door that rotates spindle 31 and collar 33, does not rotate gear 34 and thus do not drive latch bolt 35 out of engagement with the strike. In this Classroom (Locked) Mode, door 12 cannot be opened from the exterior side which thus bars entry into the room by a patient from the hallway outside this door.

When collar 33 is shifted axially to the right side Position B seen in FIGS. 13, 14, its left portion 33L of square cross-section becomes situated in square bore 34N of gear 34, where the collar's square outer surface has width W corresponding to but slightly less than square bore 34N of gear 34. Thus, pivoting of either lever 11, 32 will rotate spindle 31 which will rotate collar 33, which is drivingly coupled to the rotate gear 34 whose movement drives latch bolt 35 to decouple from the strike and allow the door to open. The latch bolt 35 in FIGS. 11-14 is conventional, and the drive mechanism to move the latch bolt in and out of latching engagement with strike may have many various forms. Movement of collar 33 to Position B occurs when a staff person inserts and turns key 36 in lock 37 (FIGS. 11 and 13), which drives collar 33 axially. In this Position B the spindle's outer square section shape is in drive engagement with hub 34 which drives lock bolt 35 to render door 12 openable by pivoting lever 11 from the exterior side. Axial movement of collar 33 to Classroom (Locked) or (Unlocked) Modes remains until reversed by use of a key in lock 37.

As noted earlier, numerous other lever-engaging mechanisms including cam/follower or spring arrangements or variations of the one shown herein are possible to achieve Position A (lever disengaged) and door locked against entry by a patient, and Position B (lever-engaged) to allow entry from the exterior side, only as allowed by a staff person, and to simultaneously maintain the Anti-Ligature Lock Release capability of the door lock system on both sides.

Also shown in FIGS. 12 and 14 is a toothless section 34E which does not engage teeth 35T of bolt 35 when levers 11 or 32 are pulled downward and thus does not drive bolt 35.

The sequence of stages of an attempted hanging suicide are illustrated in FIGS. 1-10 with the distal end 20A of ligature 20 initially looped about conical escutcheon 10A and lever 11, and the proximal end 20B formed as a noose which falls to the floor as the suicide attempt is defeated.

In FIG. 5 the distal end 20A of ligature 20 is shown looped about conical escutcheon 10A and lever 11. FIG. 6 shows that due to pulling on the proximal end 20B of ligature 20 on the interior side of door 12, the distal end 20A has started to pull lever 11 which in turn starts to pivot upward since it has minimal or no resistance to such upward pivoting. In this stage the tied end 20A has been sliding down the conical walls of the escutcheon 10A of the shank portion of lever 11. In FIG. 7 lever 11 is almost vertical, and the tied end 20A has almost slid off this handle, and in FIG. 8 distal end 20A of ligature 20 is completely free of lever 11, and consequentially opposite proximal end 20B has dropped toward the floor on the interior side of door 12, and the suicide attempt is defeated.

In Passage or Classroom (Unlocked) Modes persons on both interior and exterior sides of door 12 can unlatch and open door 12 by pushing downward on the respective interior or exterior side levers, and levers on both sides remain pivotable freely upward to defeat a suicide attempt.

The present invention provides a still further mode, herein called privacy mode, where the latch bolt assembly is switched via a key in a lock by a staff person, to bar entry from the exterior side 12B, while allowing exit from the interior side 12A, and retaining the upward release condition of levers on both the exterior side and the interior side to defeat a ligature suicide attempt. In "Classroom (Locked) Mode" the lock assembly is altered so that bolt 16 (or an optional drive element coupling the spindle transmission and the bolt 16) in a conventional lock assembly not shown, is disengaged from the door lever spindle 31, which thus bars opening the door from downward pivot of the lever from the exterior side 12B. At any subsequent time a staff person can, with a key 36 or other simple device such as a coin used in a non-lockable cylinder, switch the bolt's switch or cam element 38 coupled to collar 33 which is coupled to spindle 31 so that unlatching door 12 from the exterior side 12B is again possible.

In Passage Mode the exterior side lever 11 can be pushed downward where it will overcome normal spring and friction resistance and open the latch bolt 16, or it can be pivoted upward by ligature 20 where it will pivot freely with minimal resistance. When the lever is pivoted upward the distal part 20A of any ligature 20 looped about or tied to lever 11, will slide off quickly because of the conical taper of the escutcheon 10A and of the lever hub 11A, which together include smooth continuous or seamless surfaces and no edges that would restrain ligature 20 from sliding off. Thus, in Passage Mode a person on the outside can push lever 11 downward to open door 12 and enter the room; however, lever 11 is freely pivotable upward which will defeat a suicide attempt from a ligature tied to the exterior side lever. Any downward pivoting of a lever by a ligature tied thereto on either side of the door will also release a ligature hanging downward from such lever because of the unique shape of the lever, described in detail below.

In the Classroom (Unlocked) Mode the levers on the exterior and interior sides 11, 32 are the same as above in Passage Mode; however, in Classroom (Locked) or Lever-Disengaged Mode, on exterior side 12B, lever 11 is freely pivotable downward where it will not open the door, so that persons cannot enter without admission by a person inside or by a person with a key on the outside. The lever 11 remains freely pivotable upward to not violate the Anti-Ligature safety condition or protocol. One can use a cylinder on either side to set the Mode or an anti-ligature turnpiece apparatus on the interior side to set the Mode. On the interior side the lever will always pivot downward in Lever-Engaged Mode to open the door for egress by the patient or anyone in the room.

FIGS. 15-17 illustrate the preferred embodiment of the new lock assembly and door, which has certain differences from the embodiment of FIGS. 1-14, but where elements and components similar or the same as those in the embodiment of FIGS. 1-14 will have the same reference numbers. In both embodiments the objectives are similar, namely to have an ADA-compliant lock system with an anti-ligature design to defeat suicide attempts. The principal difference in the preferred lock system of FIGS. 15-17 is employment of a two-part spindle where interior side lever 40 is coupled to interior side lever spindle segment 41, and exterior side lever 42 is coupled to exterior side lever spindle segment 43. Both spindle segments are square in cross-section, but said spindle segments could have any section whose outer surface can be keyed to a gear or cam that would drive the bolt. In FIG. 15 spindle segment 41 slides into the mating square bore of sleeve portion 44 of lever 40. Spring 45 urges spindle 41 inward toward its collar 46 which is pivoted any time that interior side lever 40 is pivoted.

The opposite side spindle segment 43 has a similar square shank 47 and an axially spaced reduced diameter part 48. Collar 49 is formed of left part 49L secured by screw 49× to spindle segment 41, and right part 49R which is slidable between its left position seen in FIG. 15 and its right portion seen in FIG. 16. The left and right parts 49L and 49R are biased inwardly by their respective springs 49S and 49T collar part 49R is axially slidable from the position shown in FIG. 15 where its portion 49A overlies and does not engage the reduced diameter portion 48 of spindle segment 43, to a Position B (see FIG. 16) where said portion 49A of collar 49 part 49R slides onto the mating square section 47 of spindle segment 43. In Position B pivoting lever 42 engaged to collar 49 will drive the lock bolt to open the door 12.

As seen in FIGS. 15-17 collar segment 49L is secured to spindle segment 41 by bolt 49X so that rotation of lever 40 becomes coupled via spindle segment 41 to collar 49 and thence to cam 54 which is fixed at 54A to collar 49.

Spring 49T urges outside spindle segment 43, and spring 49S urges inside spindle 41 inward to the lock mechanism. Stops are provided to stop each of said spindles from moving too far inward. The stops not shown may be small pins extending perpendicularly through and extending beyond the spindle body at selected axial locations.

The mechanism to move collar part 49R from Position A (lever-disengaged) to Position B (lever-engaged) is a lever 51 driven via lock 52 operated with key 53 by a staff person. Lever 51 drives collar part 49R between its respective positions. When collar part 49R is in Position B (lever engaged) and is rotated (as seen in FIG. 17), it will drive cam 54 to allow lock bolt 55 to spring axially out of engagement with the strike plate in the door frame and allow the door to open.

Where the latch bolt is normally spring-biased to engage the strike plate, cam 54 drives the latch bolt to disengage from the strike plate. When the cam and collar are disengaged from the spindle segment 43, rotation of lever 42 will not open the door, this being the Lever-Disengaged Classroom (Unlocked) Mode. In the lock assembly shown collar, part 49R is moved by the key-lock cylinder 52 and its lever or cam 51. The inside and outside levers are designed to always defeat suicide attempts by a ligature looped over the door and pulling upward, or by a ligature hanging directly down from the lever.

In both embodiments shown above the shape and orientation of the lever and of the coupled escutcheon are significant components alone or in combination with these lock assemblies, in defeating attempts of ligature suicide. FIGS. 18-20 illustrate a preferred lever 60 and mating escutcheon 61, where lever 60 extends generally perpendicularly to the central pivot axis X-X of lever 60's hub part 62, and its handle part 60H of length L is slightly tapered in the direction of its free end, and is slightly inclined, about 1° toward the X-X axis, which enhances the ability of this lever to deflect or direct a ligature to slide off the handle when force is applied to the ligature. Also, the curved near or top end 63 of the lever's hub part 62 fits essentially seamlessly with the 55° tapered sides 64 of the truncated conical escutcheon 61, resulting in a smooth continuous curved surface extending from the top end 65 of escutcheon 61 to the generally central top area 63 of lever 60.

FIG. 18 includes the further reference indicia of 61B and 65 for the base and top surface respectively of the escutcheon, R for the radius of base 61B, L for the length of handle part 60H of lever 60 which handle part 60H extends a radial distance greater than radius R of base 61B. Also indicated in FIG. 18, hub part 62 of lever 60 has a smoothly curved convex top surface 63 that forms a smooth contiguous junction with side walls 64 of the escutcheon 61, and the handle top part 60T extends as a smooth contiguous uninterrupted surface with said top surface 63 of said hub part 62. According to the invention disclosed herein, a ligature looped onto a lever latch assembly will slide off the tapered escutcheon walls and off the smooth contiguous surfaces of the escutcheon, hub and handle parts of the lever. This is further illustrated by FIGS. 1A, 4 and 5-8, all showing one end of a ligature slipping off the lever because of the tapers and smooth junctions.

The escutcheon 61 shown has generally straight side walls 64 forming a truncated cone at 55° from the horizontal base; however, the truncated escutcheon could have straight walls of a different angle or curved walls as in an egg or hemispherical shape, so long as the walls were sufficiently steep and the lever's outer surface 63 flows smoothly into the top area 63 of the escutcheon 61 forming a smooth continuous surface off which a ligature will easily slide. FIG. 19 illustrates a further embodiment of this handle which tapers slightly and inclines about 1° toward the lever's rotation axis X-X. These aspects further induce any ligature to slide off the handle.

The invention herein covers a) the new anti-ligature releasable door lever assembly installable in a door, b) the combination of this assembly with a door, c) the conical escutcheon and lever sub-combination, and d) the method of applying these concepts for anti-ligature releasable door operation.

Although the best mode for carrying out the present invention has been described in the foregoing detailed description and illustrated in the accompanying drawings, it will be understood that the invention is not limited to the embodiments enclosed, but is capable of numerous rearrangements, modifications and substitutions of steps and elements without departing from the spirit of the invention. Accordingly, the present invention is intended to encompass such rearrangements, modifications and substitutions of steps and elements as falls within the scope of the appended claims.

APPENDIX A

| | INSIDE (Interior) | Outside (Exterior) |
|---|---|---|
| I. PASSAGE MODE | __Lever freely pivots up<br>Lever retracts bolt to permit exit | __Lever freely pivots Up<br>Lever retracts bolt to permit entry from exterior |
| IIA. CLASSROOM MODE (LOCKED) | __Lever freely pivots Up<br>Lever retracts bolt to permit exit | __Lever freely pivots Up<br>Lever decoupled from bolt by use of a key in a cylinder so that entry from |

APPENDIX A-continued

| | INSIDE (Interior) | Outside (Exterior) |
|---|---|---|
| | | exterior is barred |
| IIB. CLASSROOM MODE (UNLOCKED) | ↑_Lever freely pivots Up<br>↓ Lever retracts bolt to permit exit | ↓_Lever freely pivots Up<br>↑ Lever retracts bolt to permit entry from exterior |
| III. PRIVACY/STAFF PASSAGE MODE (same as Classroom Mode Locked but Staff person can unlock & enter from exterior | ↑_Lever freely pivots Ip<br>↓ Lever retracts bolt to permit exit | ↓_Lever freely pivots Up<br>↑ Lever decoupled from bolt, but lock may be unlocked without key which allows bolt to retract and permit entry from exterior |

All up modes could retract latch, but in the above-described embodiments it has been elected to not do so, to reduce friction

The invention claimed is:

1. A lever latch lock assembly installable in a door having interior and exterior sides, said assembly, comprising:

a. a lock housing mountable in said door and having interior and exterior sides, said housing including a lock bolt movable along a first axis, a spindle extending along a second axis generally perpendicular to said first axis, said spindle extending outward at each of said interior and exterior sides of said housing and terminating in opposite ends, and a transmission which converts rotation of said spindle to axial motion said lock bolt, b. a lever assembly attached to each of said spindle's ends and adapted to rotate said spindle, said lever assembly, including:

(1) an escutcheon formed as a truncated generally conical cylinder having:

(i) a base part having a first diameter adapted to be situated closely adjacent one of said interior and exterior sides of said door and coaxial with said second axis, (ii) a top end part having a top surface opposite said base part, said top surface having a smaller diameter than said first diameter of said base part and having a circumferential top surface, with side walls extending between said base part and said top surface, and (iii) a bore through which extends said spindle, and (2) a lever including:

(i) a hub part having a smoothly curved convex top surface with a generally round circumferential bottom edge having the same diameter as the top surface of the top end of the escutcheon, resulting in a substantially smooth continuous surface from the base part of the escutcheon toward the curved convex top surface of the hub part, a sleeve portion extending from said hub part configured to be received into said escutcheon to engage with said spindle;

(ii) an elongated handle part extending from one side of said hub part in a direction transverse of said second axis of said spindle, said handle part having a free end opposed to said hub part, said handle part having a top part that extends as a smooth continuous uninterrupted surface with said top surface of the of said hub part, said handle part extending a radial distance from said second axis greater than the length of a radius of said base part, wherein, when a cord is wrapped around the hub part during a suicide attempt, the smooth continuous surfaces of the hub part are configured to allow the cord to slip over the hub part onto the lever, and the smooth continuous surfaces of the lever are configured to allow the cord to slip and decoupled from the lever, therefore, preventing the attempted suicide.

2. The lever latch lock according to claim 1 wherein said hub includes an axial recess extending in the direction of said bottom to said top thereof, and said spindle end is extended into said recess and keyed to rotate therewith.

3. The lever latch lock assembly according to claim 1 wherein said hub part of said lever and said escutcheon have a common central axis.

4. The lever latch lock assembly according to claim 1 wherein said escutcheon walls are inclined at about 55 degrees from the plane of the base of the escutcheon.

5. The lever latch lock assembly according to claim 1 wherein said elongated handle part extends along a plane that defines an angle of about 91 degrees with said spindle axis and is inclined away from said door surface.

6. The lever latch lock assembly according to claim 1 wherein said levers on said interior and exterior sides of said door can pivot from a generally horizontal rest position downward or upward, and said transmission is adapted so that either of said interior and exterior side levers can always freely pivot upwardly when pulled upward, and said transmission will engage said lock bolt to allow said door to open when said transmission is selectively directed to do so.

7. The lock assembly according to claim 1 wherein said transmission has a Passage Mode where movement of said lever downward in said Passage Mode lever on either interior or exterior side of said door will engage said transmission and move said bolt to open said door.

8. The lock assembly according to claim 7 wherein movement of said lever upward in said Passage Mode will not move said bolt.

9. The lever latch lock assembly according to claim 1 wherein said handle part extends radially from said hub part of said lever.

10. A combination door and lever latch lock assembly installed therein, said door having interior and exterior sides, comprising:

a. a lock housing mounted in said door and having interior and exterior sides adjacent and corresponding to said interior and exterior sides of said door, said housing including a lock bolt movable along a first axis, a spindle extending along a second axis generally perpendicular to said first axis, said spindle extending outward at each of said interior and exterior sides of said housing and terminating in opposite ends, and a transmission which converts rotation of said spindle to axial motion said lock bolt, b. a lever assembly attached to each of said spindle's ends and adapted to rotate said spindle, said lever assembly, including:

(1) an escutcheon formed as a truncated generally conical cylinder having (i) a base having a first diameter adapted to be situated closely adjacent one of said interior and exterior sides of said door and coaxial with said second axis, (ii) a top end having a top surface opposite said base part, said top surface having a smaller diameter than said first diameter of said base part, and (iii) a bore through which extends said spindle, and (2) a lever including (i) a hub part having a smoothly curved convex top surface with a generally round circumferential bottom edge having the same diameter as the top surface of the top end of the escutcheon, resulting in a substantially smooth continuous surface from the base part of the escutcheon toward the curved convex top surface of the hub part, a sleeve portion extending from said hub part configured to be received into said escutcheon to engage with said spindle;

(ii) an elongated handle part extending from one side of said hub part in a direction transverse of said second axis of said spindle, said handle part having a free end opposed to said hub part, said handle part having a top part that extends as a smooth continuous uninterrupted surface with said top surface of the of said hub part, said handle part extending a radial distance from said second axis greater than the length of a radius of said base part; wherein, when a cord is wrapped around the hub part during a suicide attempt, the smooth continuous surfaces of the hub part are configured to allow the cord to slip over the hub part onto the lever, and the smooth continuous surfaces of the lever are configured to allow the cord to slip and decoupled from the lever, therefore, preventing the suicide attempt.

11. A lever latch lock assembly installable in a door having interior and exterior sides, said assembly, comprising:

a. a lock housing mountable in said door and having that has interior and exterior sides, said housing including a spindle extending from each side of said housing along a central axis, b. a lever assembly attached to said end of at least one of said spindles and adapted to rotate said spindle, said lever assembly, including:

(1) an escutcheon formed as a truncated generally conical cylinder having (i) a base of first diameter adapted to be situated closely adjacent one of said interior and exterior sides of said door and coaxial with said second axis, (ii) a top end having a top edge opposite said base, said top end having a smaller diameter than said first diameter, and (iii) a bore through which extends said spindle, and (2) a lever including (i) a hub part having a smoothly curved convex top surface with a generally round circumferential bottom edge having the same diameter as the top surface of the top end of the escutcheon, resulting in a smooth substantially continuous surface from the base part of the escutcheon toward the curved convex top surface of the hub part, a sleeve portion extending from said hub part configured to be received into said escutcheon to engage with said spindle;

(ii) an elongated handle part extending from one side of said hub part in a direction transverse of said central spindle axis, said handle part having a free end opposed to said hub part, said handle part having a top part that extends as a smooth continuous uninterrupted surface with said top surface of the of said hub part, said handle part extending a radial distance from said second axis greater than the length of a radius of said base part; wherein, when a cord is wrapped around the hub part during a suicide attempt, the smooth continuous surfaces of the hub part are configured to allow the cord to slip over the hub part onto the lever, and the smooth continuous surfaces of the lever are configured to allow the cord to slip and decoupled from the lever, therefore, preventing the suicide attempt.

12. The lever latch lock assembly according to claim 11 wherein said escutcheon walls are inclined at about 55 degrees from the plane of the base of the escutcheon.

13. The lever latch lock assembly according to claim 11 wherein said levers on said interior and exterior sides of said door can pivot from a generally horizontal rest position downward or upward, and said transmission is adapted so that either of said interior and exterior side levers can always freely pivot upwardly when pulled upward, and said transmission will engage said lock bolt to allow said door to open when said transmission is selectively directed to do so.

14. The lever latch lock assembly according to claim 11 wherein said transmission means has:

(a) a Classroom Unlocked Mode where said exterior side lever is pivotable from said generally horizontal rest position downward which will move said lock bolt and open said door, and said lever is freely movable from said generally horizontal rest position upward to an upward to an upward position herein also designated "anti ligature latch lock" release position, and (b) a Classroom Locked Mode where said lever is pivotable from said generally horizontal rest position downward which will not open said door and is freely movable upward to said "anti ligature latch lock" release position.

15. The lock assembly according to claim 14 wherein said transmission has a Passage Mode where movement of said lever downward in said Passage Mode lever on either interior or exterior side of said door will engage said transmission and move said bolt to open said door.

16. The lock assembly according to claim 15 wherein movement of said lever upward in said Passage Mode will not move said bolt.

17. The lock assembly according to claim 11 wherein said transmission further comprises a switch movable between a first position Passage Mode which allows said lever to move downward without moving said bolt to its open state, and a second position for said Classroom Locked Mode which allows said lever to move downward to move said bolt to its open state.

18. A lever and escutcheon combination attachable to the exposed end of the spindle of a door latch lock assembly which assembly includes a latch bolt movable from its extended state to its retracted state by pivoting of said lever, comprising:

a. an escutcheon formed as a truncated generally conical cylinder with a central axis and having:

(i) a base part having a first diameter (ii) a top end part having a smaller diameter than said first diameter of said base part, with side walls extending between said base part and said top end part, and (iii) a central bore through said escutcheon, and b. a lever including:

(i) a hub part having a smoothly curved convex top surface and a bottom part with a round circumferential bottom edge having the same diameter as the top end part of said escutcheon and positionable closely adjacent said top end part, resulting in a substantially smooth continuous surface from the base part of the escutcheon to the curved convex top surface of said hub part;

(ii) an elongated handle part extending from one side of said hub part in a direction transverse of said central axis of said escutcheon, said handle part having a free end opposed to said hub part, said handle part having a top part that extends as a smooth continuous uninterrupted surface with said top surface of the of said hub part, said handle part extending a radial distance from said central axis greater than the length of a radius of said base part, and (iii) a sleeve portion extending coaxially downward from said bottom part of said hub part, through said escutcheon and configured to engage said spindle end.

19. The lever and escutcheon combination of claim 18 wherein said hub part bottom edge is positioned closely adjacent said top end part of said escutcheon.

20. A lever latch lock assembly installable in a door having interior and exterior sides, said assembly, comprising:

a. a lock housing mountable in said door and having interior and exterior sides, said housing including a lock bolt movable along a first axis, a spindle extending along a second axis generally perpendicular to said first axis, said spindle extending outward at each of said interior and exterior sides of said housing and terminating in opposite ends, and a transmission which converts rotation of said spindle to axial motion said lock bolt, b. a lever assembly attached to each of said spindle's ends and adapted to rotate said spindle, said lever assembly, including:

(1) an escutcheon formed as a truncated generally conical cylinder having:

(i) a base part having a first diameter adapted to be situated closely adjacent one of said interior and exterior sides of said door and coaxial with said second axis, (ii) a top end part having a top surface opposite said base part, said top surface having a smaller diameter than said first diameter of said base part and having a circumferential top surface, with side walls extending between said base part and said top surface, and (iii) a bore through which extends said spindle, and (2) a lever including:

(i) a hub part having a smoothly curved convex top surface with a generally round circumferential bottom edge having the same diameter as the top surface of the top end of the escutcheon, resulting in a substantially smooth continuous surface from the base part of the escutcheon toward the curved convex top surface of the hub part, a sleeve portion extending from said hub part configured to be received into said escutcheon to engage with said spindle;

(ii) an elongated handle part extending from one side of said hub part in a direction transverse of said second axis of said spindle, said handle part having a free end opposed to said hub part, said handle part having a top part that extends as a smooth continuous uninterrupted surface with said top surface of the of said hub part, said handle part extending a radial distance from said second axis greater than the length of a radius of said base part, wherein, when a cord is wrapped around the hub part during a suicide attempt, the smooth continuous surfaces of the hub part are configured to allow the cord to slip over the hub part onto the lever, and the smooth continuous surfaces of the lever are configured to allow the cord to slip and decoupled from the lever, therefore, preventing the attempted suicide, and wherein said transmission has: (a) a Classroom Unlocked Mode where said exterior side lever is pivotable from said rest position downward which will move said lock bolt and open said door, and said lever is freely movable upward to an "anti ligature latch lock" release position, and (b) a Classroom Locked Mode where said lever is pivotable from its rest position downward which will not open said door and is freely movable upward to said "anti ligature latch lock" release position.

21. A lever latch lock assembly installable in a door having interior and exterior sides, said assembly, comprising:

a. a lock housing mountable in said door and having interior and exterior sides, said housing including a lock bolt movable along a first axis, a spindle extending along a second axis generally perpendicular to said first axis, said spindle extending outward at each of said interior and exterior sides of said housing and terminating in opposite ends, and a transmission which converts rotation of said spindle to axial motion said lock bolt, b. a lever assembly attached to each of said spindle's ends and adapted to rotate said spindle, said lever assembly, including:

(1) an escutcheon formed as a truncated generally conical cylinder having:

(i) a base part having a first diameter adapted to be situated closely adjacent one of said interior and exterior sides of said door and coaxial with said second axis, (ii) a top end part having a top surface opposite said base part, said top surface having a smaller diameter than said first diameter of said base part and having a circumferential top surface, with side walls extending between said base part and said top surface, and (iii) a bore through which extends said spindle, and (2) a lever including:

(i) a hub part having a smoothly curved convex top surface with a generally round circumferential bottom edge having the same diameter as the top surface of the top end of the escutcheon, resulting in a substantially smooth continuous surface from the base part of the escutcheon toward the curved convex top surface of the hub part, a sleeve portion extending from said hub part configured to be received into said escutcheon to engage with said spindle;

(ii) an elongated handle part extending from one side of said hub part in a direction transverse of said second axis of said spindle, said handle part having a free end opposed to said hub part, said handle part having a top part that extends as a smooth continuous uninterrupted surface with said top surface of the of said hub part, said handle part extending a radial distance from said second axis greater than the length of a radius of said base part, wherein, when a cord is wrapped around the hub part during a suicide attempt, the smooth continuous surfaces of the hub part are configured to allow the cord to slip over the hub part onto the lever, and the smooth continuous surfaces of the lever are configured to allow the cord to slip and decoupled from the lever, therefore, preventing the attempted suicide wherein said transmission further comprises a switch movable between a first position Passage Mode which allows said lever to move downward without moving said bolt to its open state, and a second position for said Classroom Locked Mode which allows said lever to move downward to move said bolt to its open state.

* * * * *